US006402050B1

(12) United States Patent
Kashirin et al.

(10) Patent No.: US 6,402,050 B1
(45) **Date of Patent: *Jun. 11, 2002**

(54) APPARATUS FOR GAS-DYNAMIC COATING

(76) Inventors: Alexandr Ivanovich Kashirin, Pr. Marxa, 51-87; Oleg Fedorovich Klyuev, Ul. Konchalovskogo, 7-35; Timur Valerievich Buzdygar, Pl. Kurchatova, 1-19, all of Obninsk, Kaluzhkaya obl., 249020 (RU)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 39 days.

(21) Appl. No.: 09/308,415

(22) PCT Filed: Oct. 27, 1997

(86) PCT No.: PCT/RU97/00332

§ 371 (c)(1),
(2), (4) Date: May 18, 1999

(87) PCT Pub. No.: WO98/22639

PCT Pub. Date: May 28, 1998

(30) Foreign Application Priority Data

Nov. 13, 1996 (RU) ..... 96121833

(51) Int. Cl.[7] ..... B05B 1/24

(52) U.S. Cl. ..... 239/79; 239/85; 239/336; 239/135; 239/434; 239/589

(58) Field of Search ..... 239/79, 85, 128, 239/135, 137, 138, 325, 336, 418, 419, 426, 433, 434, 8, 13, 589; 427/180, 189, 190, 192, 201, 422, 446; 118/300, 308

(56) References Cited

U.S. PATENT DOCUMENTS

| | | | | |
|---|---|---|---|---|
| 3,849,057 A | * | 11/1974 | Peck et al. | 239/434 X |
| 4,343,605 A | * | 8/1982 | Browning | 239/79 X |
| 4,717,075 A | | 1/1988 | Carter et al. | 239/398 |
| 5,120,582 A | * | 6/1992 | Browning | 239/79 X |
| 5,271,965 A | * | 12/1993 | Browning | 427/446 |
| 5,302,414 A | * | 4/1994 | Alkhimov et al. | 427/191 X |
| 5,330,798 A | * | 7/1994 | Browning | 239/79 X |
| 5,531,590 A | * | 7/1996 | Browning | 239/79 X |
| 5,932,293 A | * | 8/1999 | Belashchenko et al. | 427/446 |

FOREIGN PATENT DOCUMENTS

| | | |
|---|---|---|
| SU | 1687026 | 10/1991 |
| SU | 1776205 | 11/1992 |
| WO | WO88/04202 | 6/1988 |
| WO | WO91/19016 | 12/1991 |

* cited by examiner

*Primary Examiner*—Steven J. Ganey
(74) *Attorney, Agent, or Firm*—David L. Garrison; Garrison & Assoc . PS

(57) ABSTRACT

The apparatus is comprised of a compressed air source which is connected by a gas conduit to a heating unit whose outlet is connected to a supersonic nozzle inlet in which a supersonic portion is connected by a conduit to a powder feeder. Compressed air of pressure Po from the compressed air source by the gas conduit is delivered to the heating unit to be heated to the required temperature. The heated air enters the supersonic nozzle in which it is accelerated to a speed of several hundred meters per second. The powdered material is passed from the powder feeder by the powder feeding conduit to the supersonic nozzle portion in which it is accelerated by the air flow at section of the nozzle from the injection point to the nozzle outlet.

1 Claim, 1 Drawing Sheet

APPARATUS FOR GAS-DYNAMIC COATING

AREA OF TECHNOLOGY

The present invention relates to apparatuses for gas-dynamic spraying of powder materials and may be used in machine building and other industries for producing coatings imparting different properties to the surfaces being worked.

BACKGROUND OF THE INVENTION

Protection of structures, equipment, machinery and mechanisms from corrosion and effects of corrosive media, enhancing characteristics of materials, in particular, production of materials with specified properties and development of relevant resource-saving technologies present scientific and engineering challenges which have major practical significance.

These problems are solved by different methods, among them methods of gas-dynamic spraying of powder coatings which are based on that a powder material is injected in a gas flow and the resulting gas-powder mixture for coating is accelerated to supersonic speed [RU 1618782, RU 1618778]. To increase the powder utilization factor and the quality of spraying, prior to feeding to the supersonic nozzle the gas-powder mixture is heated to the temperature lower than the temperature of melting of powder materials [RU 1773072, WO 91/190161 RU 2038411].

For implementation of these methods the devices comprising a source of compressed gas, a gas heating unit, a powder feeder connected with either a gas heating unit inlet [RU 1603581] or a mixing chamber mounted in front of the supersonic nozzle are used [1674585, WO 91/19016, RU 2010619].

In the first case, the powder material contacts a heating-generating elements of the heating unit resulting in oxidation of powder material particles and their sticking to the element.

In the second case, the powder material does not pass through a gas heating unit, but as in the first case, has to pass through the narrowest portion of the nozzle (throat) which is particularly subject to wear by powder material, especially when solid powders are used (metals, ceramic particles etc.).It is the throat which primarily determines the supersonic nozzle operation and efficiency of the device in general.

Such design is rather awkward, as the mixing chamber is a separate component and the powder feeder should be built hermetic and be operated under high pressure, and therefore, would have a considerable weight.

The mixing chamber between the heating unit and the supersonic nozzle leads to additional heat loss, which means consumption of more power for heating the air and maintaining a prescribed temperature at the supersonic nozzle inlet.

This results in increased risk during operation of the device, as in the case of loss of integrity of hermetic sealing of the powder feeder, the powder will be emitted under high pressure.

SUMMARY OF THE INVENTION

The purpose of this invention is to produce an apparatus for gas-dynamic spray coating which would be designed to enhance the stability of operation of the nozzle assembly and prolong its service life, reduce power consumption for maintaining the air temperature at the supersonic nozzle inlet, increase operational safety and reduce apparatus weight.

This is achieved in the apparatus for spraying of powdered material, comprised of a compressed air source connected to the heating unit through a gas conduit, a powder feeder and a supersonic nozzle, by connecting the outlet of the gas heating unit to the supersonic nozzle inlet which is connected, in its supersonic portion, through a conduit to the powder feeder outlet.

This construction for spray coating, as compared with known ones, makes possible increasing the operational stability of the apparatus due to lack of nozzle throat wear. This is achieved as the powder does not pass through the throat and therefore does not induce wear, does not change its characteristics and hence does not affect the performance of the nozzle assembly and the apparatus as a whole.

When using powders of solid metals or ceramics wear of the nozzle walls occurs only in the supersonic portion of the nozzle and does not involve the nozzle throat. As the performance of the supersonic nozzle (in particular, air flow, the Mach number etc.) is determined primarily by the throat area, wear of only the supersonic portion of the nozzle permits a slower change in operational conditions of the nozzle, than when the powder is injected to the chamber in front of the nozzle or to the subsonic portion of the nozzle, thereby ensuring a longer service life of the nozzle.

In this case, an mixing chamber is not necessary, which simplifies the design and reduces the apparatus weight, while connection of the heating unit to the nozzle inlet permits the elimination of heat loss in the mixing chamber.

Coupling of the powder feeder with the supersonic portion of the nozzle permits maintaining a lower pressure in the powder feeder, than that at the nozzle inlet, as the pressure is always lower in the supersonic portion of any Laval (supersonic) nozzle than in the subsonic one. This results in the reduction in powder feeder weight and an increase in operational safety.

The design of the apparatus enables the use of atmospheric, rather than compressed air for transporting the powder from the powder feeder to the nozzle. This reduces the apparatus weight and increases operational safety even more, because in this case the powder feeder should not necessarily be hermetically sealed. For this purpose, at the point of powder injection into the nozzle a pressure below atmospheric should be maintained to provide powder transport by atmospheric air flow.

In order for the powder to be effectively transported by atmospheric air, the cross-sectional areas of the supersonic nozzle at the juncture of the nozzle and the powder-feeder conduit should be related to the throat area per the following relation $$S_i/S_k >= 1.3P_0 + 0.8$$

where $S_i$ is the cross-sectional area of the supersonic nozzle at the juncture of the nozzle and the powder feeder conduit, $S_k$ is the supersonic nozzle throat area, $P_0$ is the full gas pressure at the supersonic nozzle inlet, expressed in MPa.

BRIEF DESCRIPTION OF THE DRAWING

The advantages of the present invention are evident from the detailed description of the embodiment and the enclosed drawing which is a schematic representation of the apparatus.

PREFERRED EMBODIMENT

Figure 1:
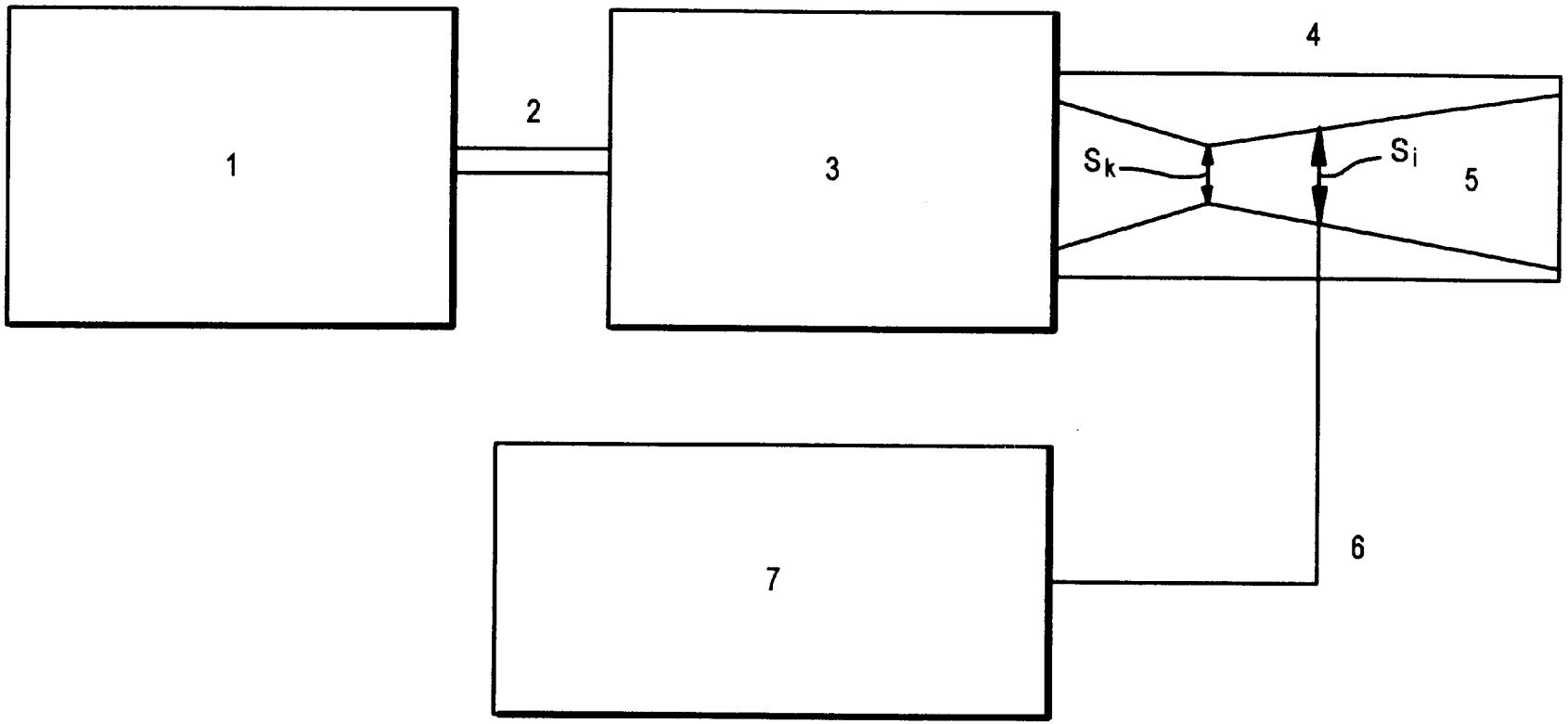

The apparatus is comprised of a compressed air source 1 which is connected by a gas conduit 2 with a heating unit 3 whose outlet is connected to a supersonic nozzle inlet 4 in which a portion outside of the throat (supersonic portion) 5 is connected by a conduit 6 to a powder feeder 7.

In operation, compressed air of pressure $P_0$ from the compressed air source 1 is delivered to the heating unit 3 by gas conduit 2 to be heated to the required temperature. The heated air enters the supersonic nozzle in which it is accelerated to a speed of several hundred meters per second.

The powder material is passed from the powder feeder. 7 by the conduit 6 to the supersonic nozzle portion 5 in which it is picked up by the air flow and accelerated at section of the nozzle from the injection point to the nozzle outlet. In the nozzle cross-section where the powder feeder conduit 6 is connected to the supersonic nozzle 4, the static pressure below atmospheric is maintained, ensuring that the air with powder is effectively drawn in from the powder feeder.

At the point of powder injection into the nozzle the pressure can be maintained below atmospheric if the cross-sectional area of the supersonic nozzle in this portion is made to exceed that of the throat by a given number of times. Numerous experiments and calculations have shown that for efficient operation of the apparatus, the cross-sectional area of the supersonic nozzle at the juncture of the nozzle and the powder feeder conduit should be related to the throat by $$S_i/S_k >= 1.3P_0 + 0.8$$

where $S_i$ is the cross-sectional area of the supersonic nozzle at the juncture of the nozzle and the powder feeder conduit, $S_k$ is the supersonic nozzle throat area, $P_0$ is the full gas pressure at the supersonic nozzle inlet, expressed in MPa.

This design ensures that there is no excessive pressure (above atmospheric) in the powder feeder, which in turn, enhances the safety of powder feeder operation and simplifies maintenance thereof.

INDUSTRIAL APPLICATION

The proposed apparatus can be used for application of powder materials to product surfaces different properties such as corrosion resistance, heat resistance, radiation properties of the surface etc. The apparatus can also be used for deposition of decorative coatings.

What is claimed is:

1. The apparatus for gas-dynamic coating of powder materials comprising a source of compressed air connected by a gas conduit to a heating unit, a powder feeder and a supersonic nozzle, said gas heating unit directly connected to the inlet of said supersonic nozzle and said supersonic nozzle being connected through a conduit to the powder feeder outlet, wherein the powder feeder is not hermetically sealed and the cross-section of the supersonic nozzle at the juncture of the nozzle and the powder feeder conduit is made according to the following requirements:

$$\frac{S_i}{S_k} > 1.3\,P_o + 0.8$$

where $S_i$ is the cross-sectional area of the supersonic nozzle at the juncture of the nozzle and the powder feeder conduit;

$S_k$ is the supersonic nozzle throat area; and $P_o$ is the full gas pressure at the supersonic nozzle inlet expressed in MPa.

* * * * *